United States Patent [19]

Traümuller et al.

[11] Patent Number: 4,550,847

[45] Date of Patent: Nov. 5, 1985

[54] STACKABLE BOX

[75] Inventors: Otfried Traümuller; Gerd Weinberg, both of Oberstenfeld, Fed. Rep. of Germany

[73] Assignees: Furnier- u. Sperrholzwerk; J. F. Werz Jr. KG Werzalit-Pressholzwerk, both of Oberstenfeld, Fed. Rep. of Germany

[21] Appl. No.: 145,056

[22] Filed: Apr. 30, 1980

[30] Foreign Application Priority Data

May 19, 1979 [DE] Fed. Rep. of Germany ..... 2920430

[51] Int. Cl.[4] ..... B65D 6/24

[52] U.S. Cl. ..... 220/4 F; 220/80

[58] Field of Search ..... 220/4 F, 80

[56] References Cited

FOREIGN PATENT DOCUMENTS 513675 10/1939 United Kingdom .

*Primary Examiner*—George E. Lowrance

*Attorney, Agent, or Firm*—Michael J. Striker

[57] ABSTRACT

A stackable box comprises a frame with four walls of substantially right-angled shape. The walls are formed with angularly extending portions which when attached to each other form the corners of the frame. At its upper edge and lower edge each wall has horizontal grooves to receive a base and a cover of the box. The angularly extending portion of each wall forms with a remaining portion of the wall a rectangularly-shaped groove. The remaining relatively flat portion of the wall is provided with at least one inwardly extending projection. The angularly extending portions of two adjacent walls are fastened to provide a stable rigid construction of the box.

7 Claims, 8 Drawing Figures

STACKABLE BOX

BACKGROUND OF THE INVENTION

The invention relates to boxes adapted to be assembled in a stack and utilized for packing and shipping fruits, vegetables or the like. More particularly, the invention relates to the structure of the stackable box, a number of such boxes being positionable above one another and adjacent to one another.

The known boxes of the foregoing type generally include a frame of four walls formed of non-flowable moldable material which have a square or rectangular shape and may be made of identical or different size. The base is inserted into a lower end of the frame and a cover is placed into an upper end of the frame to close the box.

Such boxes are utilized as one-time used or repeatedly used packing for the shipment of fruits, vegetables or the like. The one-time used boxes are usually destroyed at the station of destination.

The packing boxes should be constructed so, that when distroyed they should not be detrimental for the environment. The boxes must be so constructed that they should properly protect the products to be packed. The structure of the boxes should ensure their stability so that the boxes will not be disintegrated by the influence of moisture absorbed by the material of the box either from their content or from the environment.

The German published application DE-OS No. 1586642 discloses a one-piece box structure including thin walls connected to each other which are produced from a compound containing cellulose chips or fibers pressed with a heat-hardenable binder. The manufacture and use of such boxes has been found considerably expensive.

It has been found that one-piece boxes do not provide the required quality. In the known arrangements when one-piece boxes transported to the field they are in a stacked position and therefore they occupy a relatively large space during the transportation before loading. This causes high transportation costs and is rather inconvenient.

SUMMARY OF THE INVENTION

It is an object of the invention to provide an improved stackable box.

Another object of the invention is to provide a stackable box which permits a substantially greater number of boxes in a stack.

Still another object of the invention is to provide a ventilation system between the boxes assembled in a stack.

These and other objects of the invention are attained in a box stackable with other boxes positioned above one another and adjacent one another. The box includes a frame having four walls of rectangular shape made from non-flowable moldable material. The walls have angularly extending portions which form a corner of the box upon assembling of two neighboring walls. A base and a cover are inserted into the lower and upper ends of the frame, respectively. The angularly extending portion of each wall forms with a remaining portion of the wall a rectangularly-shaped notch which extends along the entire height of the box. The remaining portion of the wall is formed with at least one inwardly extending projection. The connecting means to connect the attached angularly extending portions are provided in the box.

The provision of the box with the inwardly extending projections formed in the walls permits to provide a ventilation system between the stacked boxes. Still another advantage of the invention has been found in that the formation of the walls with rectangularly-shaped notches provides a box structure with a relatively greater contact surface for absorption and transmission of the stacking pressures. Furthermore, this construction permits larger stacking allowances.

Each wall of the frame may be formed with the horizontally extending grooves provided in the area of the upper and lower edges of the frame to receive a base and a cover of the box respectively.

The connecting means for attaching two neighboring angularly extending portions may be formed as wire elements, clips or plastic joints surrounding the outer edges of the angularly extending portions and fastening them together.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE INVENTION

Figure 1:
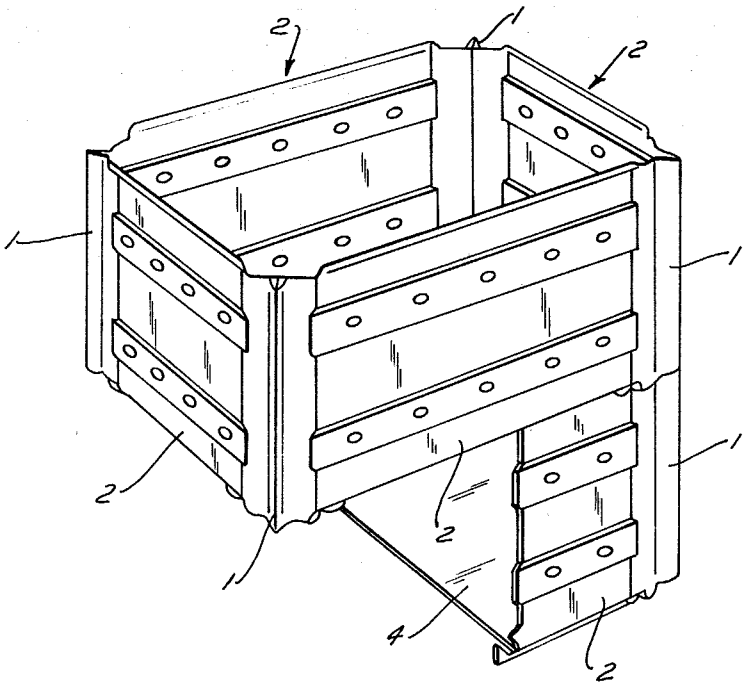
FIG. 1 is a perspective view of a stackable box with a portion of another box shown below it.

In general, a stackable box of the present invention illustrated in FIG. 1 is of the type which in a stack is positioned above or under another neighboring box. The box includes a frame 2 with four substantially identical walls 7 connected to each other at their corners 1. A base 4 is inserted into the frame of each box from the lower side thereof and a cover 6 shown in FIG. 3 is inserted into the frame 2 to close the upper opening of the box.

Figure 2:
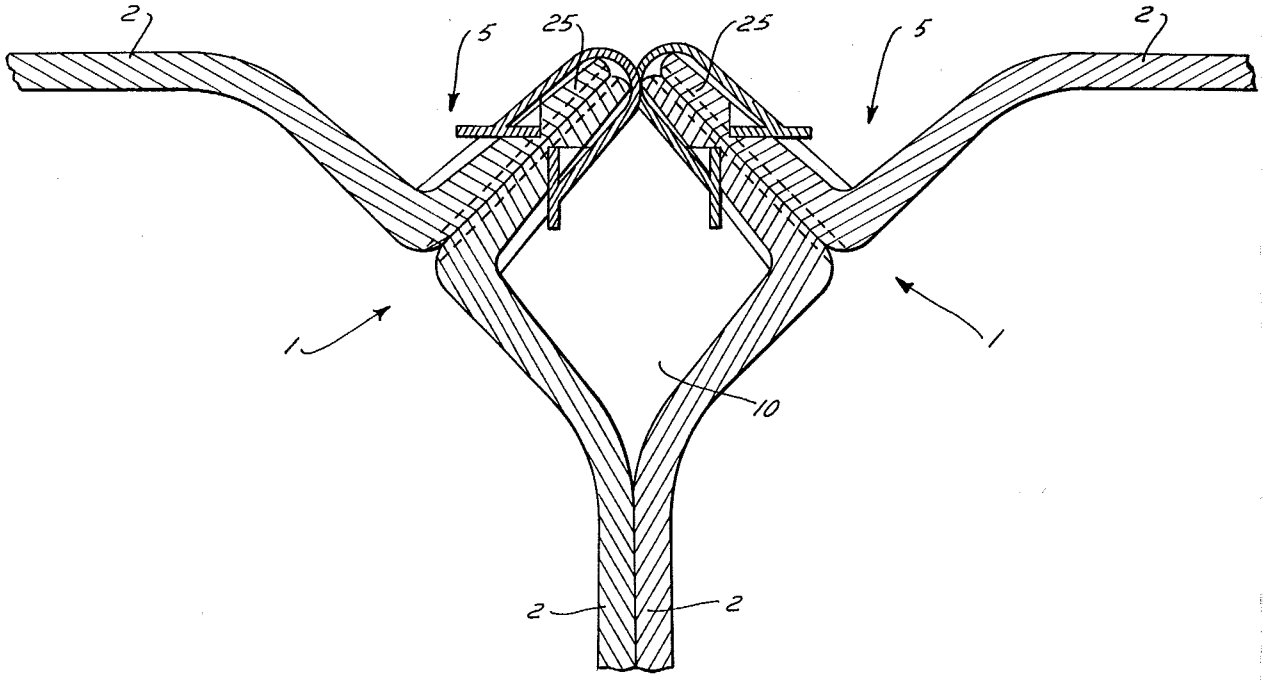
FIG. 2 is a partial horizontal section showing two adjacent corners of two neighboring boxes.

FIG. 2 shows an enlarged portion of the frame's corners 1 which are formed by the edges of adjacent walls. In the area of the corners 1 the walls 2 are provided with notches 5 extending along the entire height of the walls; in other words the walls 7 are deflected in this area to form depressions of a substantically rectangular shape.

Figure 3:
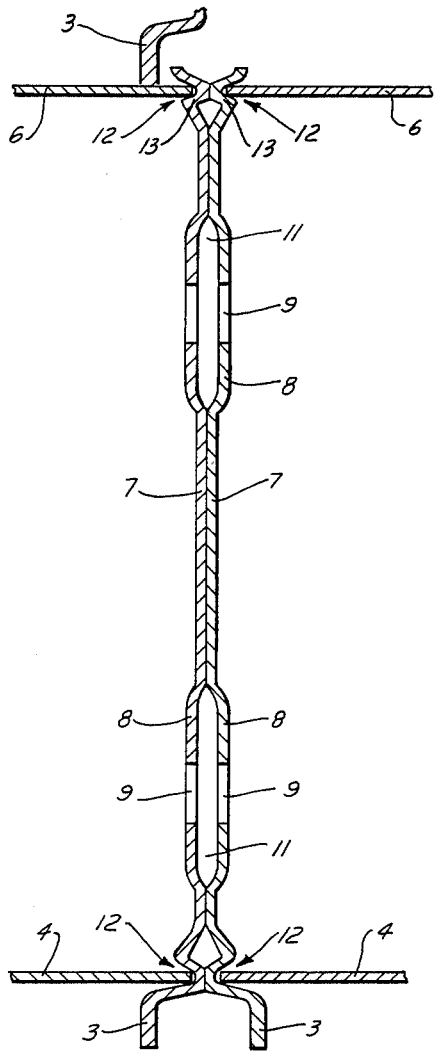
FIG. 3 is a partial sectional elevational view showing two adjacent walls of two neighboring boxes.

Referring to FIG. 3, the frames 2 have walls 7 which are formed with inwardly projecting extentions 8 wherein openings 9 are provided. The extensions 8 are provided to increase the rigidity of the walls without increasing the thickness of the frame's corners which endure the main forces in the stackable box, which are proportional to high pressures exerted in the loaded boxes. Therefore, with the provision of the construction of the boxes according to the invention a relatively larger number of the boxes may be stacked one above the other.

As may be seen in FIGS. 2 and 3 the notches 5 and wall surfaces 7 form in spaces between two adjacent boxes a vertical channel 10 and a horizontal channel 11 respectively which constitute a channel system of the stackable box. This channel system permits fresh air to circulate through the boxes and their content to thereby ventilate and cool the latter. When the openings 9 in the walls 7 of the neighboring boxes are communicate with each other the interiors of the boxes are connected with the channel system for air circulation.

The upper and lower edges of the walls 7 are provided with grooves 12 each having a supporting portion 13 formed to receive the cover 6 and the base 4 respectively. The lower edges of the walls are formed with inwardly and downwardly extending portions 3 which cooperate with the corresponding upper portions of the grooves 12 formed at the upper edges of the walls of the downwardly positioned neighboring box. Such construction prevents the boxes in the stack from displacement in a horizontal plane by forming a locking connection between the boxes. The construction of the stackable box of the invention also provides reliable and relatively simple fixing of covers 6 and bases 4 within the boxes. In this construction the bases 4 and covers 6 inserted into horizontally extending grooves 12 form in assembly a formlocking connection.

In order to use the boxes of the construction of the foregoing type for packing and shipping fruits, or vegetables or other commodities the boxes are first assembled. For this purpose sets of individual walls, bases and covers are transported to a user site such as a field, where the walls are assembled by connecting their corners to form the frames, whereupon the boxes are inserted into the frames; then the boxes are loaded, closed by the covers and stacked.

Figure 5:
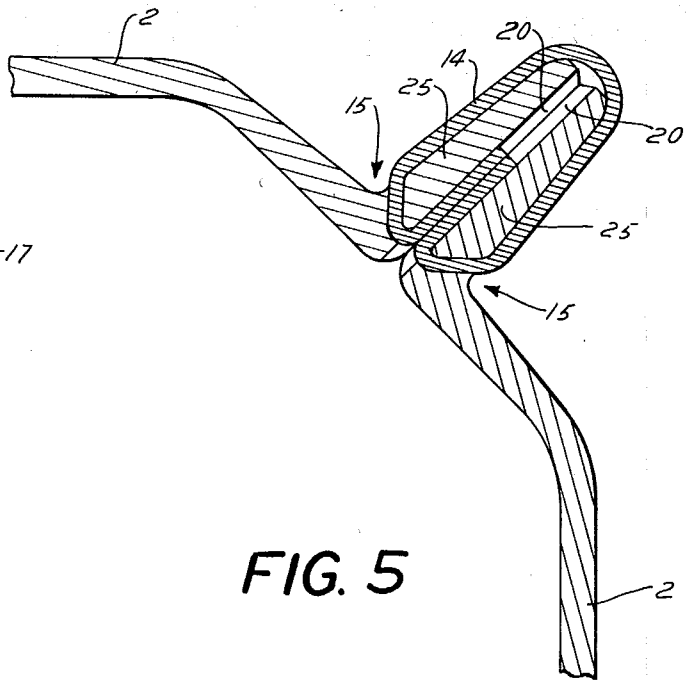
FIG. 5 shows a sectional view of another embodiment of the connecting arrangement.
Figure 4:
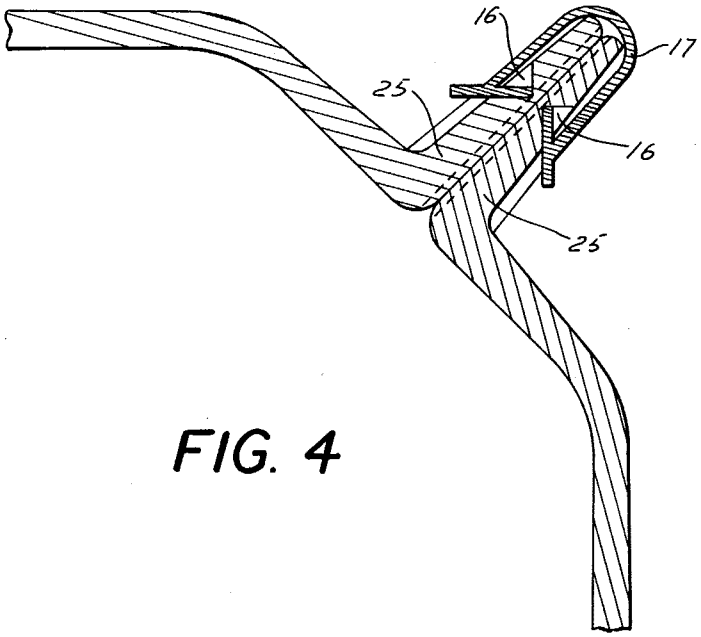
FIG. 4 shows a sectional view of a first embodiment of a connecting arrangement of the invention.

FIGS. 4 and 5 illustrate two different embodiments of the form-locking connection of the walls provided at the corners of the frame 2 wherein the adjacent walls are jointed to each other.

As shown in FIG. 5, the connection of two adjacent walls of the frame is provided by means of wires 14 surrounding the outer surfaces of two angular extentions 25 of the jointed walls. The boxes may be so assembled that three of four corners in the box are connected by wires 14 so that each corner of the open frame remains flat after connecting thereof to provide a relatively flat surface on which other similarly flat preconnected walls can be placed for storage and shipping. The inner edges of the angular extensions 25 are formed with grooves 20 which upon connection provide a space to receive the ends of wires 14 inserted therein to form a formlocking connection at the corners of the adjacent walls. For mounting the wires 14 on the edges of extensions 25 weakened portions 15 are provided at the transition of the walls 7 to the corners 1 to facilitate the penetration of wires 14 through the body of the wall into the grooves 20.

Instead of the connection used in FIG. 5, the spring clip 17 shown in FIG. 4 may be provided to establish a lock-formed connection between two adjacent walls. For this purpose each angular extension 25 of the walls 7 is formed with a recess 16 provided on an outer surface of the extension 25. Instead of clips, a rivet or a pin made from a hardened or stiffened material such as metal may be pressed into the material of the box. The pins penetrate into the edges of the walls and then they are bent to provide a form-locking connection of the adjacent edges. To facilitate the penetration of the pins the corresponding weakened portions 15 are provided on the extentions 25 in the manner described above.

Figure 7:
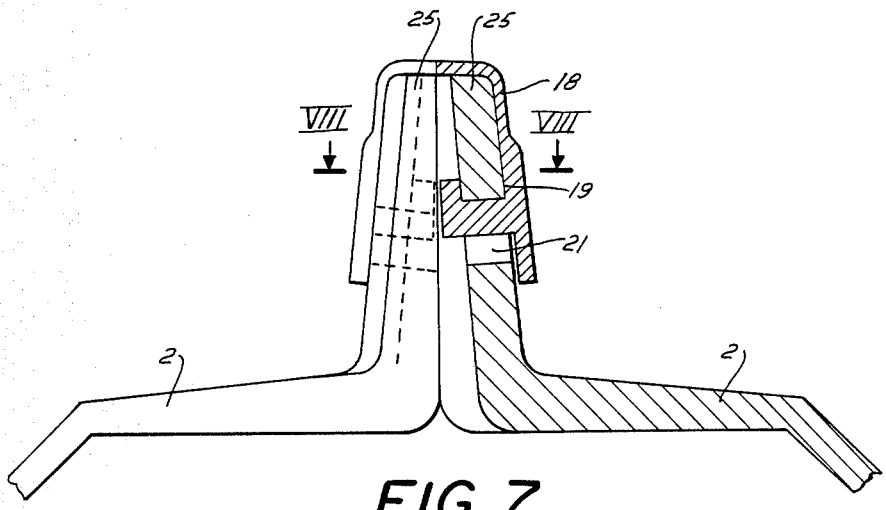
FIG. 7 is a sectional view of still another embodiment of the connecting arrangement with the plastic joint shown in FIG. 6.
Figure 8:
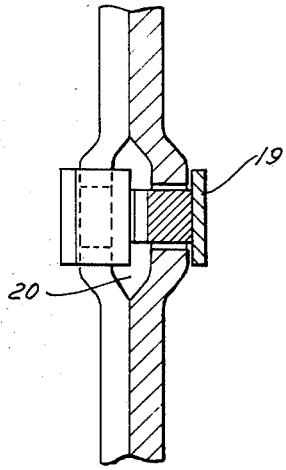
FIG. 8 is a sectional view taken along line VIII—VIII of FIG. 7.
Figure 6:
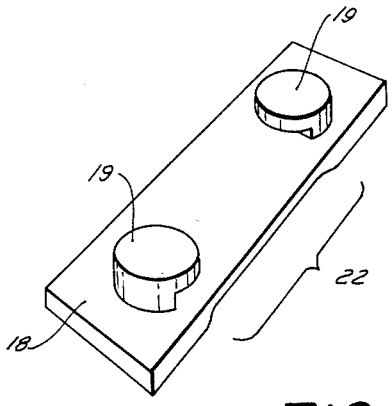
FIG. 6 is a perspective view of a plastic joint.

For connecting the walls at all corners, integral hinges having plates 18 (one shown in FIG. 6) made from any conventional suitable synthetic plastic material may be provided in the assembly as shown in FIGS. 6–8. The plates 18 are formed with undercut flanges 19. The angular extensions 25 of the walls have grooves 20 and formed with openings 21 to receive the extending portion of the flange 19 of the plate when the latter is in a bent position and surrounds the outer surfaces of two adjacent angular portions 25. The central transverse axis of the plate 18 forms an integral hinge when the plate is mounted on the angular portions 25. The flanges 19 are inserted into the openings 21.

The bent portions of flanges 19 extend, upon insertion, into a space formed by adjacent grooves 20, thereby constituting a locking connection. In assembling, at least three individual walls are disposed one next to the other one and the plastic plates 18 are put on the neighboring portions of the walls in a superimposed relationship, the flanges 19 of plates 18 are inserted into corresponding openings 21 so that a thinned zone 22 which becomes stretched when the frame is erected and each plastic plate 18 holds the flanges 19 thereof so that the flanges 19 are reliably clamped within the grooves 20, thereby providing an integral hinge connection between two neighboring walls.

The above-described assembly provide a stable and rigid construction of the stackable box used for packing and shipping fruits and vegetables or the like.

It will be understood that each of the elements described above, or two or more together, may also find a useful application in other types of stackable box differing from the types described above.

While the invention has been illustrated and described as embodied in a stackable box, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various application without omitting features that, from the standpoint of prior art, fairly constitute essential characteristics of the generic or specific aspects of this invention.

What is claimed as new and desired to be protected by Letters Patent is set forth in the appended claims:

1. A stackable box, comprising a frame having four walls made from non-flowable moldable material and being of substantially right-angled shape, said walls having angularly extending portions which, upon assembling of two neighboring walls form a corner of said frame, a base inserted into a lower edge of said frame, and a cover inserted into an upper edge of said frame to close the box, said angularly extending portion of each wall forming with a remaining portion of said wall a rectangularly-shaped notch, said notch extending along the entire height of said box, said remaining portion of said wall being formed with at least one inwardly extending projection, each said wall being formed with a first longitudinal groove provided at a lower edge thereof and with a second longitudinal groove provided at an upper edge thereof, said base in assembly being positioned within the respective first longitudinal grooves of the assembled walls and said cover being positioned within the respective second longitudinal grooves of the assembled walls; and means to connect the attached ones of said angularly extending portions of said walls to each other, each of said walls being further provided in the area of said inwardly extending projection with an opening so that the projections of two neighboring walls of two adjacent boxes placed in a horizontal row and said openings therein form ventilation channels for circulation fresh air through the boxes.

2. The stackable box of claim 1, wherein said frame has a rectangular shape.

3. The stabkable box of claim 1, wherein said frame has a square shape.

4. The stackable box of claim 1, wherein said connecting means include a clip embracing said attached angularly extending portions upon assembling of two neighboring walls.

5. The stackable box of claim 4, wherein said angularly extending portions of said walls are provided with recesses each formed at an outer edge of each of said angularly extending portions to receive said clips upon insertion thereof into two attached angularly extending portions.

6. The stackable box of claim 5, wherein said angularly extending portions include weakened parts to facilitate said insertion of said clips.

7. The stackable box of claim 1, wherein said connecting means include an element surrounding said attached angularly extending portions and including end portions extended into said attached angularly extending portions upon assembly of two neighboring walls.

* * * * *